US011629864B2

(12) United States Patent
Song et al.

(10) Patent No.: US 11,629,864 B2
(45) Date of Patent: Apr. 18, 2023

(54) MULTI-TYPE AIR CONDITIONER

(71) Applicant: LG ELECTRONICS INC., Seoul (KR)

(72) Inventors: Chiwoo Song, Seoul (KR); Yongcheol Sa, Seoul (KR); Ilyoong Shin, Seoul (KR); Ahrae Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/394,595

(22) Filed: Aug. 5, 2021

(65) Prior Publication Data

US 2022/0049860 A1 Feb. 17, 2022

(30) Foreign Application Priority Data

Aug. 11, 2020 (KR) ..... 10-2020-0100233

(51) Int. Cl.

| | |
|---|---|
| ***F24F 3/10*** | (2006.01) |
| ***F24F 11/84*** | (2018.01) |
| ***F24F 1/0007*** | (2019.01) |
| ***F24F 1/0038*** | (2019.01) |
| ***F24F 1/0063*** | (2019.01) |
| ***F24F 13/10*** | (2006.01) |

(52) U.S. Cl.

CPC ..... *F24F 3/10* (2013.01); *F24F 1/0038* (2019.02); *F24F 1/0063* (2019.02); *F24F 1/00075* (2019.02); *F24F 1/00077* (2019.02); *F24F 11/84* (2018.01); *F24F 13/10* (2013.01)

(58) Field of Classification Search

CPC ..... F24F 3/10; F24F 1/00075; F24F 1/00077; F24F 1/0038; F24F 1/0063; F24F 11/84; F24F 13/10; F24F 1/32; F25B 2313/007; F25B 2313/023; F25B 41/42

USPC ..... 165/219

See application file for complete search history.

(56) References Cited

U.S. PATENT DOCUMENTS

2005/0150243 A1 7/2005 Matsuoka et al.

FOREIGN PATENT DOCUMENTS

| | | | |
|---|---|---|---|
| CN | 104329759 | | 2/2015 |
| JP | 07-151419 | | 6/1995 |
| JP | H07151419 A | * | 6/1995 |
| JP | 2004-150686 | | 5/2004 |
| JP | 2005-283058 | | 10/2005 |
| JP | 2007-225159 | | 9/2007 |
| WO | WO 2008/072929 | | 6/2008 |

OTHER PUBLICATIONS

European Search Report issued in Application No. 21190246.5 dated Dec. 21, 2021.

Chinese Office Action issued in Application No. 202110901067.2 dated Oct. 10, 2022.

* cited by examiner

*Primary Examiner* — Steve S Tanenbaum

(74) *Attorney, Agent, or Firm* — Ked & Associates

(57) ABSTRACT

A multi-type air conditioner may include three pipes, including a high-pressure pipe, a low-pressure pipe, and a liquid line which may be connected to a plurality of indoor units, in which some of the indoor units may be operated in a cooling mode and the rest of the indoor units may be operated in a heating mode, such that waste heat from the indoor units operated in the heating mode may be recovered to be used for the indoor units operated in the cooling mode.

19 Claims, 12 Drawing Sheets

| REMARK | Operation mode | | | |
|---|---|---|---|---|
| | Cool | | Heat | |
| Fig |  |  |  |  |
| 210 | Heat | OFF | Heat | OFF |
| 220 | Cool | Cool | Heat | Heat |
| REMARK | | DEHUMIDIFICATION | Full load | Part Load |

[HEATING-ONLY OPERATION]

[HEATING-MAIN OPERATION]

[COOLING-ONLY OPERATION]

[COOLING-MAIN OPERATION]

MULTI-TYPE AIR CONDITIONER

CROSS-REFERENCE TO RELATED APPLICATION

This application claims priority under 35 U.S.C. § 119 to Korean Application No. 10-2020-0100233 filed on Aug. 11, 2020, whose entire disclosure is hereby incorporated by reference.

BACKGROUND

1. Field

A multi-type air conditioner capable of cooling and heating indoor air is disclosed herein.

2. Background

An air conditioner is a device for cooling/heating indoor air or purifying the indoor air to provide a user with a more comfortable indoor environment. These days, for more efficient cooling or heating of an indoor space which is divided into multiple rooms, there has been continuous development of a multi-type air conditioner for cooling or heating each room.

In the multi-type air conditioner, multiple indoor units are connected to one outdoor unit, and at least one indoor unit is installed in each room, in which the indoor unit performs either a heating operation or a cooling operation for conditioning the indoor air. A distributor for connecting the outdoor unit and the indoor units may be provided in the multi-type air conditioner, in which a refrigerant pipe is connected to the distributor so that gaseous refrigerant or liquid refrigerant may be supplied to the indoor units according to requirements of the indoor space.

A general multi-type air conditioner is classified into a type in which all of a plurality of indoor units performs a cooling operation or a heating operation, and a type in which some of the plurality of indoor units performs the cooling operation, and the rest of the indoor units performs the heating operation. However, in the general multi-type air conditioner, even when some of the plurality of indoor units performs the cooling operation and the rest of the indoor units performs the heating operation, outside air and indoor air may not be circulated. In addition, the general multi-type air conditioner has a problem in that when some of the plurality of indoor units performs the cooling operation and the rest of the indoor units performs the heating operation, waste heat from any one indoor unit is not recovered, thereby resulting in low efficiency.

BRIEF DESCRIPTION OF THE DRAWINGS

The embodiments will be described in detail with reference to the following drawings in which like reference numerals refer to like elements wherein.

DETAILED DESCRIPTION

Figure 1:
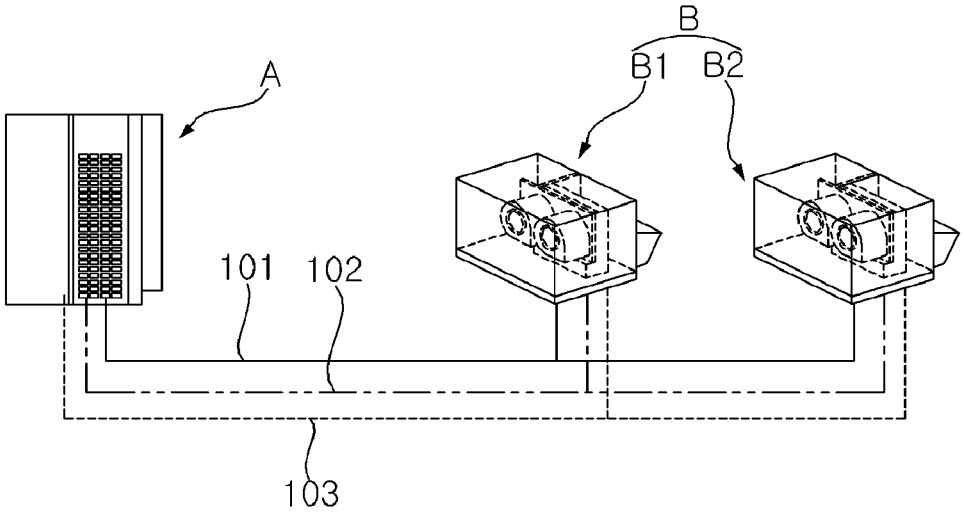
FIG. 1 is a schematic perspective view of a multi-type air conditioner according to an embodiment.

Advantages and features of embodiments will be more clearly understood from exemplary embodiments described below with reference to the accompanying drawings. However, the embodiments are not limited to the following embodiments but may be implemented in various different forms. The embodiments are provided only to complete disclosure and to fully provide a person having ordinary skill in the art to which the embodiments pertain with the category, and the embodiments will be defined by the scope of the appended claims. Wherever possible, like reference numerals generally denote like elements through the specification.

Hereinafter, embodiments will be described with reference to the accompanying drawings.

FIG. 1 is a schematic perspective view of a multi-type air conditioner according to an embodiment. Referring to FIG. 1, the multi-type air conditioner according to an embodiment may include an outdoor unit A and indoor units B.

There may be a plurality of indoor units B which may perform a cooling operation or a heating operation. In this embodiment, both the indoor units B may perform the cooling operation or the heating operation. Further, in this embodiment, while some of the indoor units B performs the cooling operation, the other indoor units B may perform the heating operation. The indoor units B may cool, heat, or dehumidify outside air drawn in from the outside.

Figure 2:
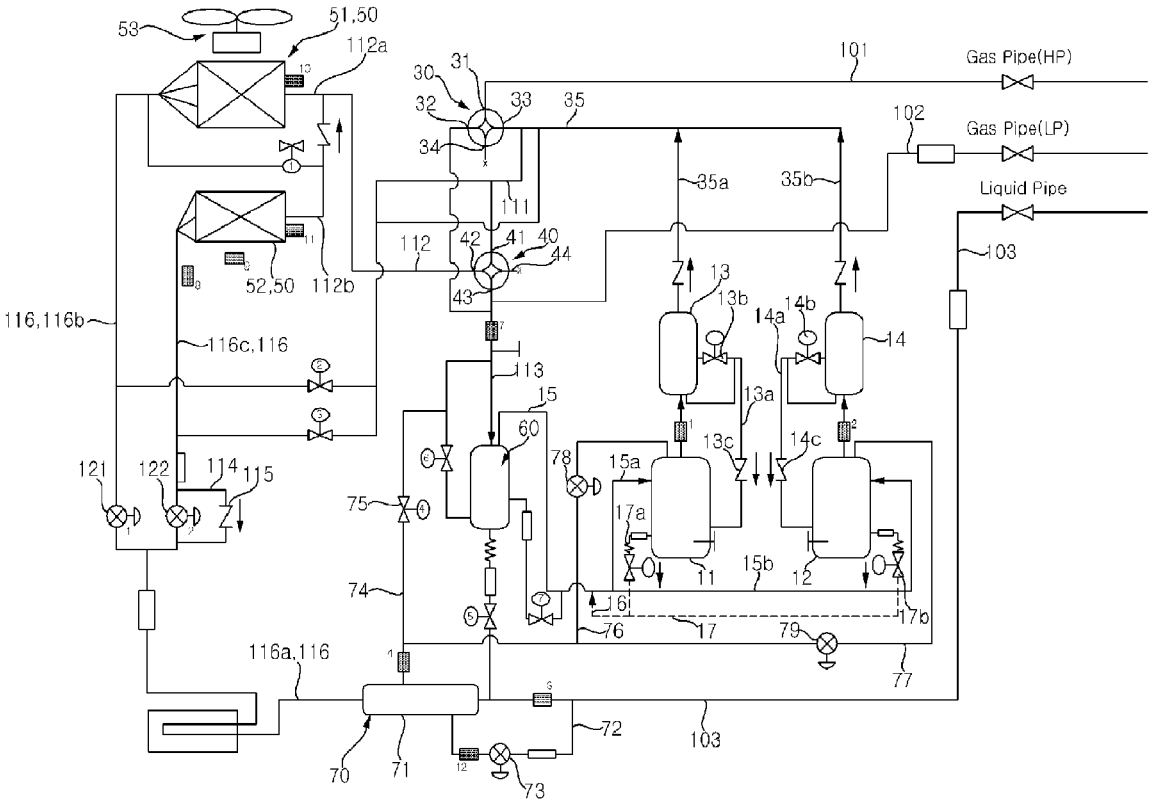
FIG. 2 is a diagram illustrating an outdoor unit of the multi-type air conditioner of FIG. 1.

FIG. 2 is a diagram illustrating an outdoor unit of the multi-type air conditioner of FIG. 1. Referring to FIG. 2, the outdoor unit A may include a first compressor 11; a first oil separator 13 that separates oil from refrigerant discharged from the first compressor 11; a second compressor 12; a second oil separator 14 that separates oil from a refrigerator discharged from the second compressor 12; a first four-way valve 30 connected to the first oil separator 13 and the second oil separator 14 to receive refrigerant, and connected to the indoor units B to circulate the refrigerant; an accumulator 60 connected to the first compressor 11 and the second compressor 12 to supply refrigerant; an outdoor heat exchanger 50 that performs heat exchange between refrigerant and air; a second four-way valve 40 that connects the accumulator 60, the outdoor heat exchanger 50, and the first four-way valve 30; and a supercooler 70 disposed between the indoor unit B and the outdoor heat exchanger 50 and that supercools the refrigerant. In this embodiment, an inverter compressor is used as the first compressor 11 and the second compressor 12.

The outdoor unit A may further include a first oil pipe 13*a* that connects the first oil separator 13 and the first compressor 11 and returns oil to the first compressor 11; a valve 13*b* disposed in the first oil pipe 13*a* and controlling a flow of oil; and a check valve 13*c* disposed in the first oil pipe 13*a* and causing the oil to flow only toward the first compressor 11. The outdoor unit A may further include a second oil pipe 14*a* that connects the second oil separator 14 and the second compressor 12 and returns oil to the second compressor 12; a valve 14*b* disposed in the second oil pipe 14*a* and controlling a flow of oil; and a check valve 14*c* disposed in the second oil pipe 14*a* and causing the oil to flow only toward the second compressor 12.

The first four-way valve 30 may receive refrigerant from the first oil separator 13 and the second oil separator 14. The first four-way valve 30 may include a 1-1 passage 31, a 1-2 passage 32, a 1-3 passage 33, and a 1-4 passage 34.

The 1-1 passage 31 may be connected to the indoor units B, and a high-pressure pipe 101 may be connected to the 1-1 passage 31. The 1-2 passage 32 may be connected to the indoor units B, and a low-pressure pipe 102 may be connected to the 1-1 passage 31.

The 1-3 passage 33 may be connected to the first oil separator 13 and the second oil separator 14, and a refrigerant supply pipe 35 may be connected to the 1-3 passage 33. The refrigerant supply pipe 35 may be connected to the first oil separator 13 and the second oil separator 14. The refrigerant supply pipe 35 may be branched to be connected to the first oil separator 13 and the second oil separator 14.

In this embodiment, the refrigerant supply pipe connected to the first oil separator 13 will be referred to as a "first refrigerant supply pipe" 35*a*, and the refrigerant supply pipe connected to the second oil separator 14 will be referred to as a "second refrigerant supply pipe" 35*b*. Further, in this embodiment, the 1-4 passage 34 is closed.

The second four-way valve 40 may include a 2-1 passage 41, a 2-2 passage 42, a 2-3 passage 43, and a 2-4 passage 44. The 2-1 passage 41 may be connected to the first four-way valve 30, and in this embodiment, may be connected to the refrigerant supply pipe 35. A pipe that connects the 2-1 passage 41 and the refrigerant supply pipe 35 will be referred to as a "first four-way valve pipe" 111. The 2-2 passage 42 may be connected to the outdoor heat exchanger 50. A pipe that connects the 2-2 passage 42 and the outdoor heat exchanger 50 will be referred to as a "second four-way valve pipe" 112.

The outdoor heat exchanger 50 may include a first outdoor heat exchanger 51 and a second outdoor heat exchanger 52, and the second four-way valve pipe 112 may be connected in parallel to the first outdoor heat exchanger 51 and the second outdoor heat exchanger 52. A pipe branched from the second four-way valve pipe 112 to be connected to the first outdoor heat exchanger 51 will be referred to as a "2-1 four-way valve pipe" 112*a*, and a pipe connected to the second outdoor heat exchanger 52 will be referred to as a "2-2 four-way valve pipe" 112*b*.

The 2-3 passage 43 may be connected to the accumulator 60. A pipe that connects the 2-3 passage 43 and the accumulator 60 will be referred to as a "third four-way valve pipe" 113. In this embodiment, the 2-4 passage 44 is closed.

In the outdoor unit A, a pipe that connects the third four-way valve pipe 113 and the 1-2 passage 32 will be referred to as a "fourth four-way valve pipe" 118. A pipe that connects the supercooler 70 and the outdoor heat exchanger 50 will be referred to as a "supercooler-outdoor heat exchanger connection pipe" 116.

The outdoor heat exchanger 50 may include the first outdoor heat exchanger 51 and the second outdoor heat exchanger 52, such that the connection pipe 116 is branched. The connection pipe 116 may include a first connection pipe 116*a* connected to the supercooler 70; a second connection pipe 116*b* branched from the first connection pipe 116*a* to be connected to the first outdoor heat exchanger 51; and a third connection pipe 116*c* branched from the first connection pipe 116*a* to be connected to the second outdoor heat exchanger 52.

A first outdoor expansion valve 121 may be disposed in the second connection pipe 116*b*, and a second outdoor expansion valve 122 may be disposed in the third connection pipe 116*c*. An expansion valve bypass pipe 114 may be provided, which is connected to the third connection pipe 116*c* by bypassing the second outdoor expansion valve 112, and one or a first end of the expansion valve bypass pipe 114 is connected to the third connection pipe 116*c* disposed between the second outdoor heat exchanger 52 and the second outdoor expansion valve 112, and the other or a second end thereof is connected to the third connection pipe 116*c* disposed between the supercooler 70 and the second outdoor expansion valve 122.

A check valve 115 may be disposed in the expansion valve bypass pipe 114. The check valve 115 may cause refrigerant to flow from the second outdoor heat exchanger 52 only toward the supercooler 70.

A pipe that connects the supercooler 70 and the indoor units B will be referred to as a "liquid line" 103. The liquid line 103 may be connected to the connection pipe 116 through the supercooler 70.

The supercooler 70 may include a supercooling heat exchanger 71; a supercooling bypass pipe 72 branched from the liquid line 103 to be connected to the supercooling heat exchanger 71; a supercooling expansion valve 73 disposed in the supercooling bypass pipe 72; a supercooler-accumulator connection pipe 74 that connects the supercooling heat exchanger 71 and the accumulator 60; and the valve 75 disposed in the connection pipe 74. An electronic expansion valve may be used as the supercooling expansion valve 73. By controlling an opening degree of the supercooling expansion valve 73, a portion of the refrigerant flowing to the liquid line 103 may be bypassed to the supercooling heat exchanger 71. The refrigerant expanded in the supercooling expansion valve 73 may be expanded in the supercooling heat exchanger 71 and may cool the refrigerant flowing from the first connection pipe 116*a* to the liquid line 103. When the valve 75 is open, the refrigerant evaporated in the supercooling heat exchanger 71 may be supplied to the accumulator 60 through the connection pipe 74.

A pipe for bypassing the refrigerant of the supercooling heat exchanger 71 to the compressor may be provided. In this embodiment, supercooler-compressor connection pipes 76 and 77, which are branched from the supercooling bypass pipe 72 to be bypassed to the first compressor 11, and expansion valves 78 and 79 disposed in the connection pipes 76 and 77 may be further included. Of the supercooler-compressor connection pipes 76 and 77, one that is connected to the first compressor 11 will be referred to as a "first supercooler-compressor connection pipe" 76, and the other that is connected to the second compressor 12 will be referred to as a "second supercooler-compressor connection pipe" 77.

The expansion valves 78 and 79 may be disposed in the first supercooler-compressor connection pipe 76 and the second supercooler-compressor connection pipe 77, respectively. The expansion valves 78 and 79 may be electronic expansion valves which may control an opening degree.

A pipe that connects the accumulator 60 and the compressor will be referred to as an "accumulator-compressor connection pipe" 15. In this embodiment, the accumulator-compressor connection pipe may be branched into two pipes to be connected to the first compressor 11 and the second compressor 12. Of the accumulator-compressor connection pipes, one that is connected to the first compressor 11 will be referred to as a "first accumulator-compressor connection pipe" 15*a*, and the other that is connected to the second compressor 12 will be referred to as a "second accumulator-compressor connection pipe" 15*b*.

An oil equalizing pipe 17 may be further included for maintaining an equal level of liquid refrigerant and oil stored in the first compressor 11 and the second compressor 12. In the oil equalizing pipe 17, valves 17*a* and 17*b* may be disposed at a side of the first compressor 11 and at a side of the second compressor 12, respectively, and the amount of oil to be discharged may be controlled by opening and closing the valves 17*a* and 17*b*. In addition, a bypass pipe 16 may be further provided that connects the oil equalizing pipe 17 and the accumulator-compressor connection pipe 15.

Figure 3:
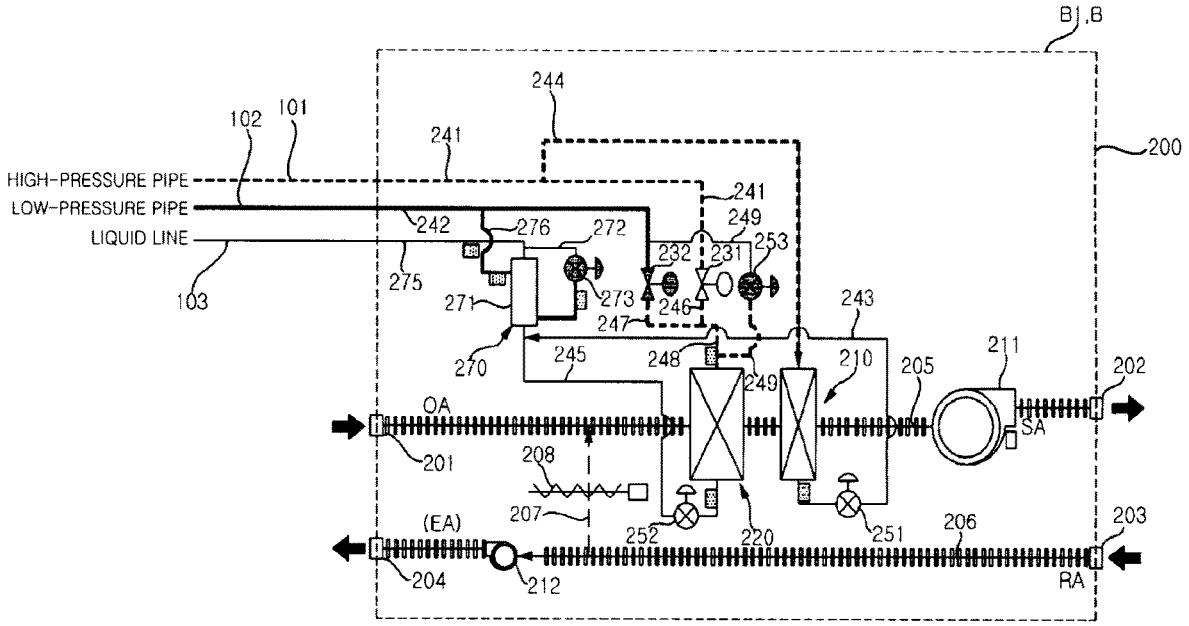
FIG. 3 is a diagram of indoor units of the multi-type air conditioner of FIG. 1.

FIG. 3 is a diagram of indoor units of the multi-type air conditioner of FIG. 1. Referring to FIG. 3, the indoor unit B may include a case 200, and a first indoor heat exchanger 210 and a second indoor heat exchanger 220 which are disposed in the case 200. The case 200 may include a first inlet 201 through which outside air may be drawn in; a first outlet 202 through which air, having passed through the first indoor heat exchanger 210 and the second heat exchanger 220, may be discharged into a room; a second inlet 203 through which indoor air may be drawn in; and a second outlet 204 through which air inside the case 200 may be discharged to the outside.

The indoor unit B may further include, inside the case 200, a first indoor unit passage 205 that connects the first inlet 201 and the first outlet 202; a second indoor unit passage 206 that connects the second inlet 203 and the second outlet 204; and an indoor unit bypass passage 207 that connects the first indoor unit passage 205 and the second indoor unit passage 206.

The first indoor heat exchanger 210 and the second indoor heat exchanger 220 may be disposed on the first indoor unit passage 205. Air flowing through the first indoor unit passage 205 may be heat-exchanged with the second indoor heat exchanger 220 and the first indoor heat exchanger 210. That is, the air in the first indoor unit passage 205 may flow in the order of the first inlet 201, the second indoor heat exchanger 220, the first indoor heat exchanger 210, and the first outlet 202.

Air in the second indoor unit passage 206 may flow from the second inlet 203 to the second outlet 204. As damper 208 opens and closes, the air in the second indoor unit passage 206 may be bypassed to the first indoor unit passage 205, and then may flow in the order of the second indoor heat exchanger 220, the first indoor heat exchanger 210, and the first outlet 202. A first indoor fan 211 may be disposed in the first indoor unit passage 205, and a second indoor fan 212 may be disposed in the second indoor unit passage 206.

The indoor unit B may include the damper 208 disposed in the indoor bypass passage 207 and controlling an air flow amount in the indoor bypass passage 207. By controlling an opening degree of the damper 208, a portion of the air discharged from the inside to the outside may return toward the first indoor unit passage 205. By controlling the damper 208 to return the discharged indoor air, an indoor load may be reduced.

The indoor unit B may further include a high pressure valve 231 connected to the high pressure pipe 101 and controlling a flow of refrigerant; a low pressure valve 232 connected to the low pressure pipe 102 and controlling a flow of refrigerant; an indoor high pressure pipe 241 that connects the high pressure valve 231 and the high pressure pipe 201; an indoor high-pressure bypass pipe 244 that connects the indoor high pressure pipe 241 and the first indoor heat exchanger 210; an indoor low pressure pipe 242 that connects the low pressure valve 232 and the low pressure pipe 102; an indoor supercooler 270 disposed between the indoor low pressure pipe 242 and the indoor heat exchangers 210 and 220 and that selectively supercools flowing refrigerant; an indoor supercooler-liquid line connection pipe 275 that connects the indoor supercooler 270 and the liquid line 103; a first supercooler connection pipe 243 that connects the first indoor heat exchanger 210 and the indoor supercooler 270; and a second supercooler connection pipe 245 that connects the second indoor heat exchanger 220 and the indoor supercooler 270.

A first indoor expansion valve 251 may be disposed in the first supercooler connection pipe 243, and a second indoor expansion valve 252 may be disposed in the second supercooler connection pipe 245. An electronic expansion valve may be used as the first indoor expansion valve 251 and the second indoor expansion valve 252.

Both the high-pressure valve 231 and the low-pressure valve 232 may be connected to the second indoor heat exchanger 220. A pipe that connects the high pressure value 231 and the second indoor heat exchanger 220 will be referred to as a "high pressure valve-second indoor heat exchanger connection pipe" 246, and a pipe that connects the low pressure value 232 and the second indoor heat exchanger 220 will be referred to as a "low pressure valve-second indoor heat exchanger connection pipe" 247.

The connection pipes 246 and 247 may be connected in series to the second indoor heat exchanger 220. In this embodiment, a junction pipe 248 may be further included, to which the connection pipes 246 and 247 may be joined, and the junction pipe 248 may be connected to the second indoor heat exchanger 220.

The indoor unit B may further include a low-pressure bypass pipe 249 that connects the junction pipe 248 and the indoor low-pressure pipe 242. A third expansion valve 253 is disposed in the low-pressure bypass pipe 249. In this embodiment, an electronic expansion valve may be used as the third expansion valve 253.

The first supercooler connection pipe 243 and the second supercooler connection pipe 245 may be connected to the indoor supercooler 270, and in this embodiment, the first supercooler connection pipe 243 and the second supercooler connection pipe 245 may be joined to be connected to the indoor supercooler 270. The indoor supercooler 270 may selectively supercool liquid refrigerant supplied from the first supercooler connection pipe 243 and the second supercooler connection pipe 245 by bypassing and evaporating a portion of the liquid refrigerant flowing in the indoor supercooler 270.

The indoor supercooler 270 includes an indoor supercooling heat exchanger 271 disposed in the second supercooler connection pipe 245; an indoor supercooling bypass pipe 272 branched from the second supercooler connection pipe 245 to be connected to the indoor supercooling heat exchanger 271; an indoor supercooling expansion valve 273 disposed in the indoor supercooling bypass pipe 272; and an indoor supercooler return line 276 that connects the indoor supercooling heat exchanger 271 and the indoor low pressure pipe 242. The second supercooler connection pipe 245 connects the indoor supercooling heat exchanger 271 and the second supercooling heat exchanger 220.

One or a first end of the indoor supercooling bypass pipe 272 may be connected to the indoor supercooler-liquid line connection pipe 275, and the other or a second end thereof may be connected to the indoor supercooling heat exchanger 271. By controlling an opening degree of the first indoor expansion valve 251, the controller may selectively expand the refrigerant flowing through the first supercooler connection pipe 243, and by controlling an opening degree of the second indoor expansion valve 252, the controller may selectively expand the refrigerant flowing through the second supercooler connection pipe 245.

Figure 4:
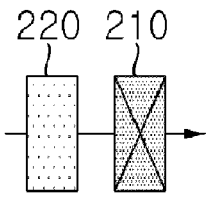
FIG. 4 is a table showing an operating state of indoor heat exchangers according to an operation mode of the multi-type air conditioner of FIG. 1.
Figure 4:
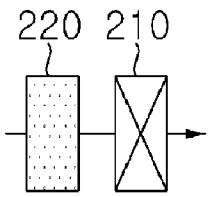
Figure 4:
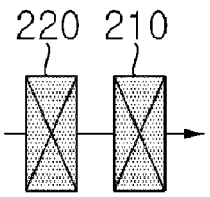
Figure 4:
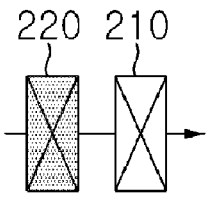

FIG. 4 is a table showing an operating state of indoor heat exchangers according to an operation mode of the multi-type air conditioner of FIG. 1. Referring to FIG. 4, a cooling mode is classified into two modes for one indoor unit B in this embodiment.

First, in a case in which refrigerant is condensed in the first indoor heat exchanger 210, and the refrigerant is evaporated in the second indoor heat exchanger 220, air passing through the first indoor passage 205 is reheated/dehumidified, and air cooled in the second indoor heat exchanger 220 is heated in the first indoor heat exchanger 210. By controlling the indoor unit in this manner, air at a similar temperature to the indoor air may be discharged from the first outlet 202, and by controlling an amount of refrigerant supplied to the first indoor heat exchanger 210 or the second indoor heat exchanger 220, the indoor unit may be operated in response to a low cooling load.

Second, in a case in which a flow of refrigerant to the first indoor heat exchanger 210 is blocked, and the refrigerant is evaporated in the second indoor heat exchanger 220, only the second indoor heat exchanger 220 operates such that the air passing through the first indoor unit passage 205 is cooled, and cold air is discharged through the first outlet 202 of the indoor unit B. In this case, the indoor unit may be operated in response to a high cooling load of a room.

In this embodiment, a heating mode is also classified into two modes for one indoor unit B.

First, in a case in which refrigerant is condensed in the first indoor heat exchanger 210 and the second indoor heat exchanger 220, condensation heat is released from the first indoor heat exchanger 210 and the second indoor heat exchanger 220, and heated air is discharged through the first outlet 202 of the indoor unit B. As heat is released from both the first indoor heat exchanger 210 and the second indoor heat exchanger 220, the indoor unit may be operated in response to a high heating load.

Second, in a case in which a flow of refrigerant to the first indoor heat exchanger 210 is blocked, and the refrigerant is condensed in the second indoor heat exchanger 220, heat is released from only the second indoor heat exchanger 220, such that the indoor unit may be operated in response to a low heating load.

A heating-only operation mode is an operation mode in which all the plurality of indoor units B are operated in a heating mode, and a cooling-only operation mode is an operation mode in which all of the plurality of indoor units B are operated in a cooling mode. A heating-main simultaneous operation mode is a mode in which some of the plurality of indoor units B are operated in a heating mode, and the rest of the indoor units B are operated in a cooling mode, and which corresponds to a case in which a heating load at the side of the indoor units B is greater than a cooling load. A cooling-main simultaneous operation mode is a mode in which some of the plurality of indoor units B are operated in a heating mode, and the rest of the indoor units B are operated in a cooling mode, and which corresponds to a case in which a cooling load at the side of the indoor units B is greater than a heating load.

Figure 5:
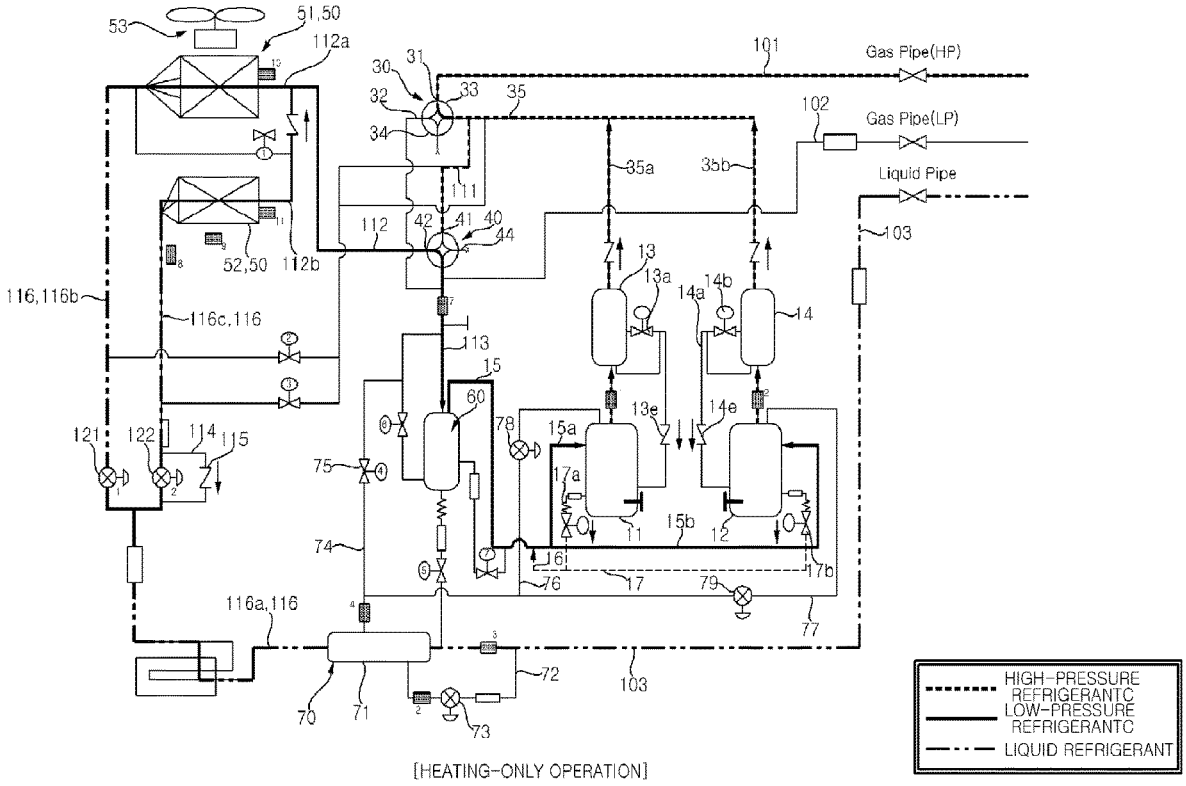
FIG. 5 is a diagram illustrating a flow of refrigerant when the outdoor unit illustrated in FIG. 2 is operated in a heating-only operation mode.
Figure 6:
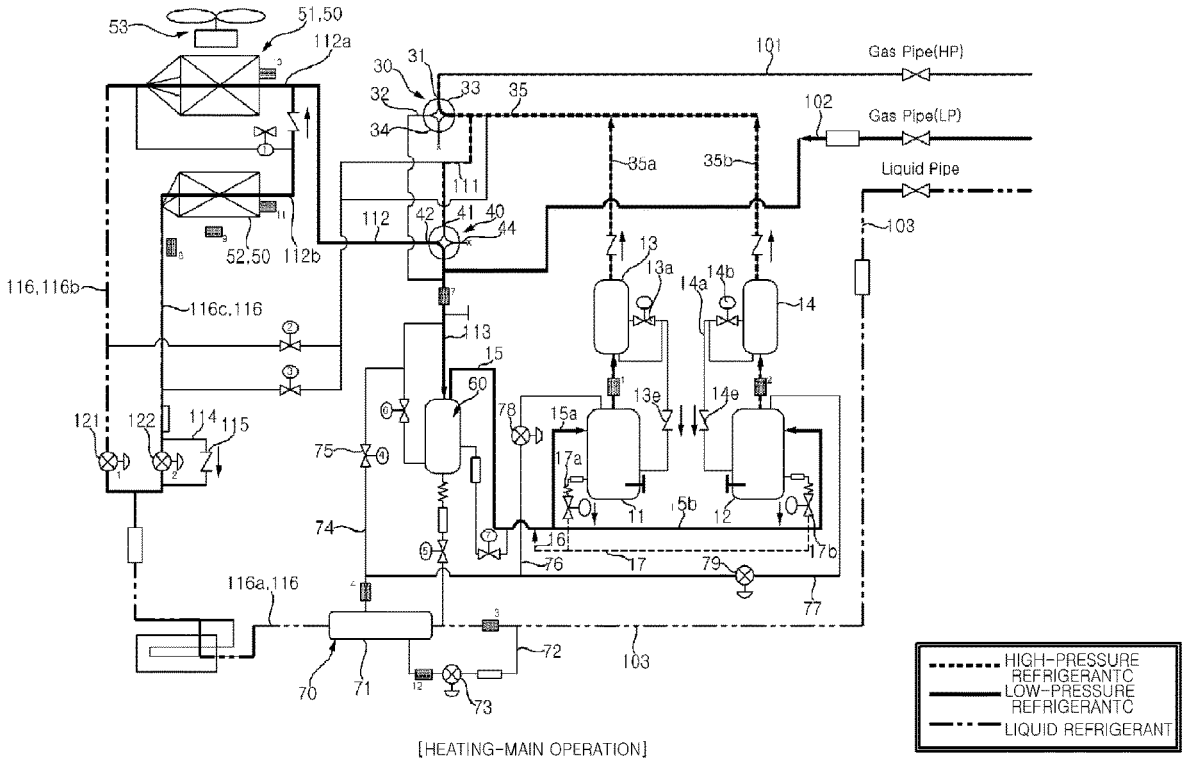
FIG. 6 is a diagram illustrating a flow of refrigerant when the outdoor unit illustrated in FIG. 2 is operated in a heating-main simultaneous operation.

FIG. 5 is a diagram illustrating a flow of refrigerant when the outdoor unit illustrated in FIG. 2 is operated in a heating-only operation mode. FIG. 6 is a diagram illustrating a flow of refrigerant when the outdoor unit illustrated in FIG. 2 is operated in a heating-main simultaneous operation mode.

In the case in which all of the indoor units B perform the heating operation or the heating load at the side of the indoor units B is greater than the cooling load, the outdoor unit A performs the heating operation. Referring to FIG. 5, during the heating operation, the outdoor unit A operates the first compressor 11 and the second compressor 12, and the compressed refrigerant is supplied to the first four-way valve 30 through the refrigerant supply pipe 35.

During the heating operation, the controller of the outdoor unit connects the 1-1 passage 31 and the 1-3 passage 33 of the first four-way valve 30, without connecting the 1-2 passage 32 and the 1-4 passage 34. Accordingly, compressed refrigerant supplied to the first four-way valve 30 is supplied to the indoor units B through the high-pressure pipe 101 to be condensed in the indoor units B, and the condensed refrigerant returns again to the outdoor unit A through the liquid line 103.

The refrigerant in the liquid line 103 flows to the supercooler 70 and the supercooler-outdoor heat exchanger connection pipe 116. By controlling an opening degree of the first outdoor expansion valve 121 and the second outdoor expansion valve 122, liquid refrigerant may be expanded, and after the expanded refrigerant is expanded in the first outdoor heat exchanger 51 and the second outdoor heat exchanger 52, the refrigerant may be supplied to the second four-way valve 40 through the second four-way valve pipe 112.

The controller connects the 2-2 passage 42 and the 2-3 passage 43 of the second four-way valve 40. Accordingly, the refrigerant supplied to the second four-way valve 30 may be supplied to the accumulator 60 through the third four-way valve pipe 113. The accumulator 60 may separate the supplied refrigerant into liquid and gaseous refrigerants, and then may supply the separated gaseous refrigerant to the respective compressors 11 and 12 through the accumulator-compressor connection pipe 15.

In the case in which all of the plurality of indoor units B perform the heating operation, the refrigerant does not flow through the low-pressure pipe 102 as illustrated in FIG. 5. When the heating load and cooling load are required at the same time and the heating load is greater than the cooling load, refrigerant also flows through the low-pressure pipe 102 as illustrated in FIG. 6.

Referring to FIG. 6, the indoor units B performing the cooling operation expand the condensed refrigerant to cool the indoor air, and the evaporated refrigerant returns to the outdoor unit A through the low-pressure pipe 102. The evaporated refrigerant, flowing through the low-pressure pipe 102, returns to the accumulator 60 through the third four-way valve pipe 113. The refrigerant evaporated in the outdoor heat exchanger 50 and the refrigerant evaporated in the indoor units B are joined to the third four-way valve pipe 113.

The flow of refrigerant described above with reference to FIG. 5 also applies to the following description.

Figure 7:
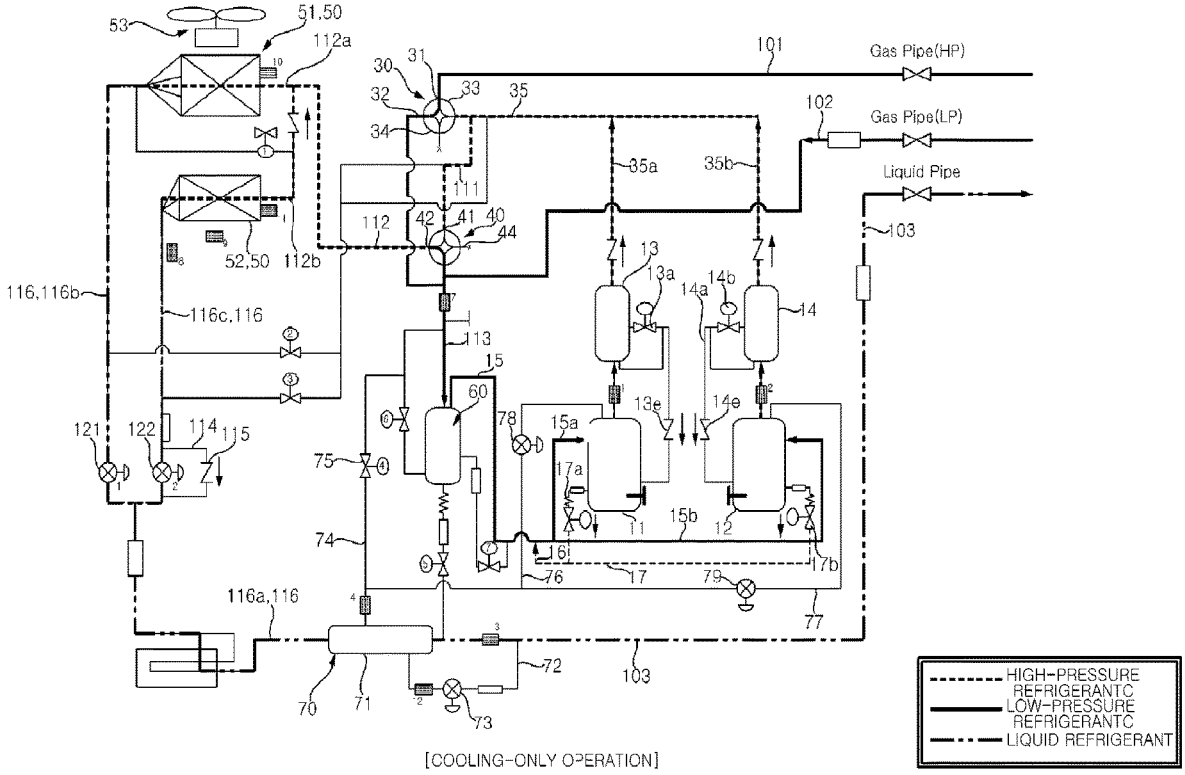
FIG. 7 is a diagram illustrating a flow of refrigerant when the outdoor unit illustrated in FIG. 2 is operated in a cooling-only operation mode.
Figure 8:
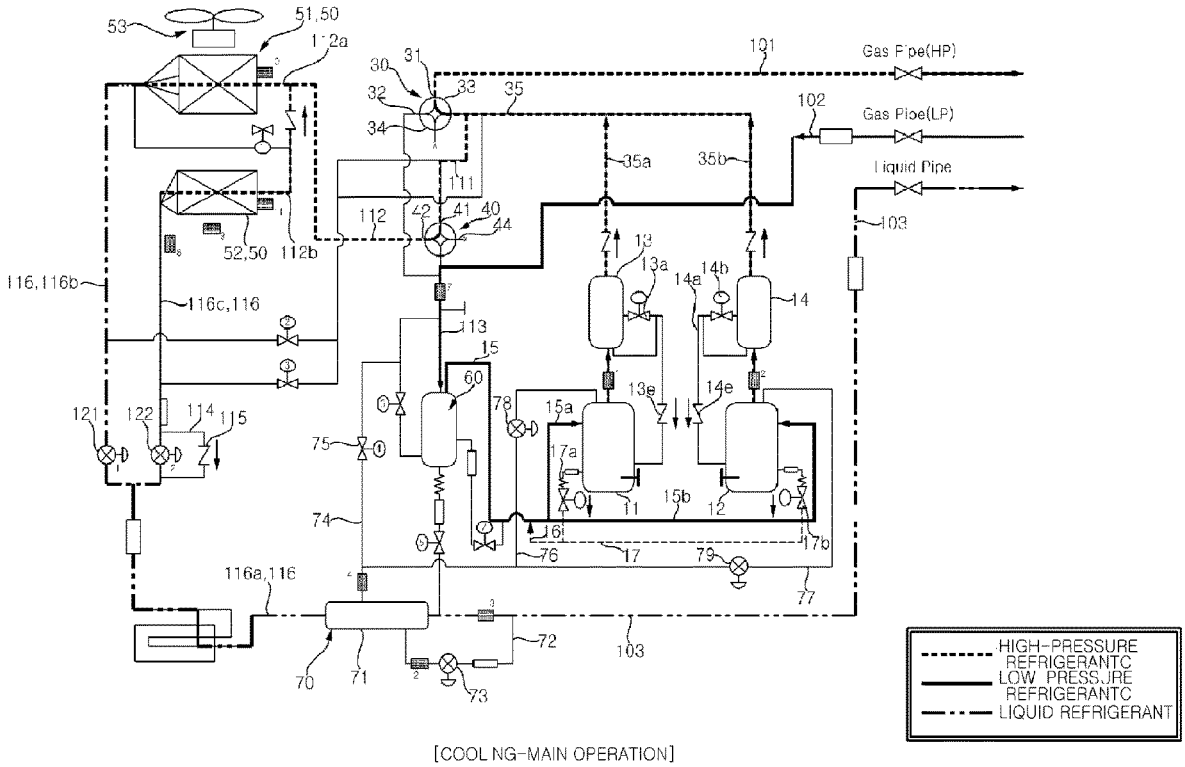
FIG. 8 is a diagram illustrating a flow of refrigerant when the outdoor unit illustrated in FIG. 2 is operated in a cooling-main simultaneous operation.

FIG. 7 is a diagram illustrating a flow of refrigerant when the outdoor unit illustrated in FIG. 2 is operated in a cooling-only operation mode. FIG. 8 is a diagram illustrating a flow of refrigerant when the outdoor unit illustrated in FIG. 2 is operated in a cooling-main simultaneous operation mode.

In the case in which all of the indoor units B perform the cooling operation or the cooling load at the side of the indoor units B is greater than the heating load, the outdoor unit A performs the heating operation. Referring to FIG. 7, during the cooling operation, the outdoor unit A operates the first compressor 11 and the second compressor 12, and the compressed refrigerant is supplied to the first four-way valve 30 through the refrigerant supply pipe 35.

During the cooling operation, the controller of the outdoor unit connects the 1-1 passage 31 and the 1-2 passage 32 of the first four-way valve 30, without connecting the 1-3 passage 33 and the 1-4 passage 34. Accordingly, compressed refrigerant supplied to the 1-3 passage 33 is supplied to the second four-way valve 40 through the first four-way valve pipe 111.

The controller of the outdoor unit connects the 2-1 passage 41 and the 2-2 passage 42 of the second four-way valve 40, without connecting the 2-3 passage 43 and the 2-4 passage 44. By controlling the outdoor unit in this manner, compressed refrigerant is supplied to the first outdoor heat exchanger 51 and the second outdoor heat exchanger 52 through the second four-way valve pipe 112, and each of the first outdoor heat exchanger 51 and the second outdoor heat exchanger 52 condenses the compressed refrigerant.

The refrigerant, having passed through the first outdoor heat exchanger 51 and the second outdoor heat exchanger 52, is supplied to the indoor units B by passing through the supercooler-outdoor heat exchanger connection pipe 116, the supercooler 70, and the liquid line 103. The indoor units B, supplied with condensed refrigerant through the liquid line 103, expands and evaporates the refrigerant to cool the indoor air. The refrigerant evaporated in the indoor units B returns to the outdoor unit A through the high-pressure pipe 101 and the low-pressure pipe 102.

The refrigerant returning through the high-pressure pipe 101 flows to the accumulator 60 through the fourth four-way valve pipe 118. The fourth four-way valve pipe 118 connects the 1-2 passage 32 of the first four-way valve 30 and the third four-way valve pipe 113.

The refrigerant returning through the low-pressure pipe 102 flows to the accumulator 60 through the third four-way valve pipe 113. The accumulator 60 separates the supplied refrigerant into liquid and gaseous refrigerants, and supplies the separated gaseous refrigerant to the respective compressors 11 and 12 through the accumulator-compressor connection pipe 15.

When all the plurality of indoor units B perform the cooling operation, the refrigerant in the indoor units B returns through the high-pressure pipe 101 and the low-pressure pipe 102 as illustrated in FIG. 7. By contrast, if the heating load and the cooling load are required at the same time and the cooling load is greater than the heating load, the refrigerant in the indoor units B returns only through the low-pressure pipe 102 as illustrated in FIG. 8, unlike FIG. 7, and the compressed refrigerant is supplied to the indoor units B through the high-pressure pipe 101. In this case, the controller connects the 1-3 passage 33 and the 1-1 passage 31 of the first four-way valve 30, and connects the 2-1 passage 41 and the 2-2 passage 42 of the second four-way valve 40.

By using the control method, the flow of refrigerant through the fourth four-way valve pipe 118 illustrated in FIG. 7 is blocked. Accordingly, a portion of the compressed refrigerant supplied to the first four-way valve 30 is supplied to the second four-way valve 40 through the first four-way valve pipe 111, and the remaining refrigerant is supplied to the first four-way valve 30.

The compressed refrigerant supplied to the first four-way valve 30 is supplied to any one of the indoor units B through the high-pressure pipe 101 to provide heating. The refrigerant condensed in the indoor units B, which are supplied with the compressed refrigerant, may return to the outdoor unit A through the low-pressure pipe 102.

Figure 9:
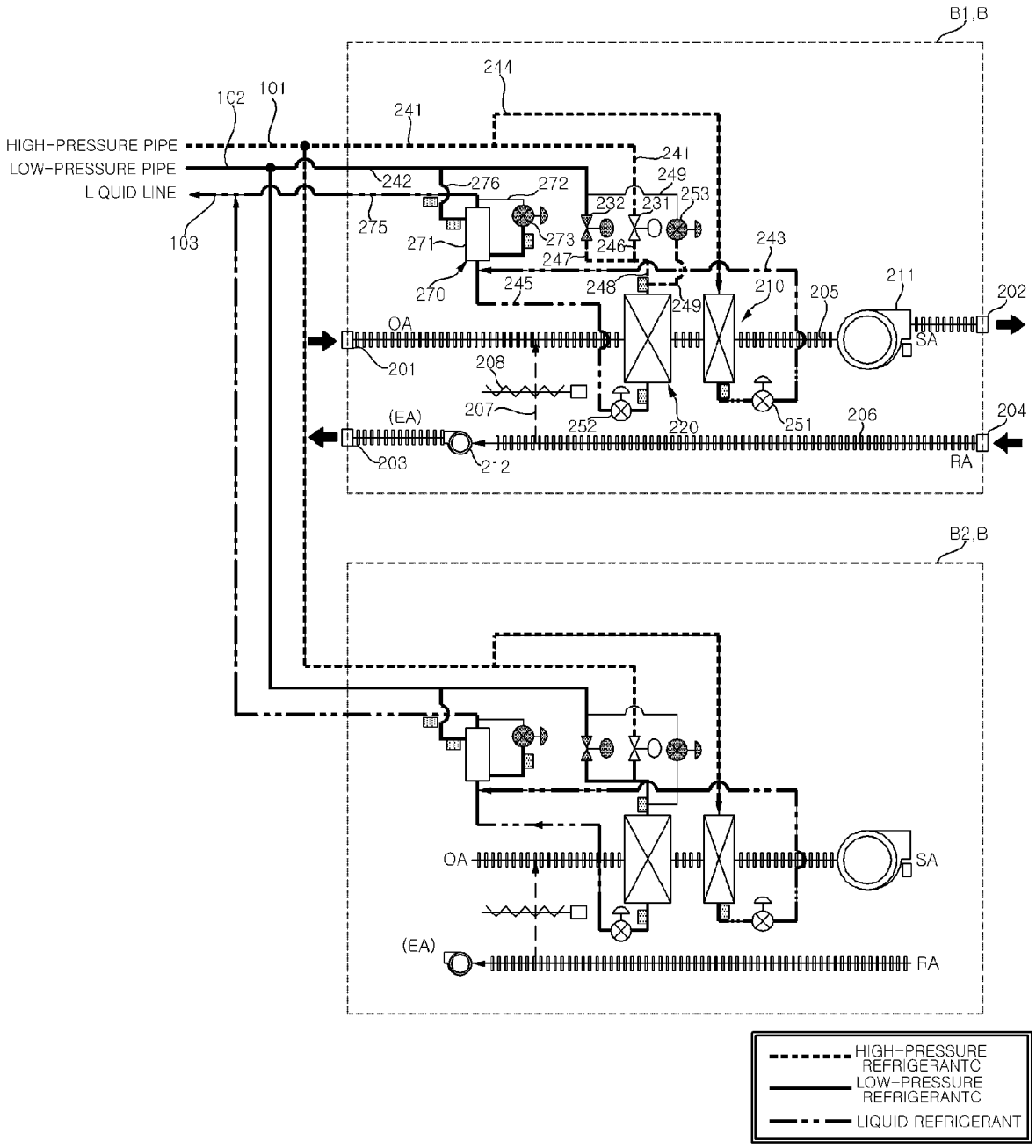
FIG. 9 is a diagram illustrating a flow of refrigerant when the plurality of indoor units illustrated in FIG. 3 are operated in a heating-only operation mode.

FIG. 9 is a diagram illustrating a flow of refrigerant when the plurality of indoor units illustrated in FIG. 3 are operated in a heating-only operation mode. In the heating-only operation mode, both the indoor units B1 and B2 perform the heating operation. The heating-only operation mode will be described with reference to FIG. 9.

The outdoor unit A performs the heating operation, and the high-pressure refrigerant supplied from the outdoor unit A is supplied to the indoor high-pressure pipe 241 through the high-pressure pipe 101. The refrigerant supplied to the indoor high-pressure pipe 241 is supplied to the first indoor heat exchanger 210 through the indoor high-pressure bypass pipe 244, and the first indoor heat exchanger 210 performs heat exchange between the air and refrigerant in the first indoor unit passage 205 to condense the refrigerant. The controller of the indoor units opens the high-pressure valve 231 and closes the low-pressure valve 232.

The high-pressure refrigerant supplied from the outdoor unit A is supplied to the second indoor heat exchanger 220 through the high-pressure pipe 101 and the high-pressure valve-second indoor heat exchanger connection pipe 246, and the second indoor heat exchanger 220 condenses the refrigerant by heat exchange between the air and refrigerant in the first indoor unit passage 205. The air in the first indoor unit passage 205 may be indoor air bypassed through the indoor bypass passage 207 or may be outside air drawn in through the first inlet 201.

The controller of the indoor units fully opens the first indoor expansion valve 251 and the second indoor expansion valve 252, and causes the refrigerant, having passed through the first indoor heat exchange 210 and the second indoor heat exchanger 220, to flow to the indoor supercooler 270. The controller of the indoor units may selectively operate the indoor supercooler 270 by referring to indoor temperature and outdoor temperature.

During operation of the indoor supercooler 270, a portion of the liquid refrigerant in the indoor supercooler-liquid line connection pipe 275 is bypassed to the indoor supercooling bypass pipe 272, and is expanded through the indoor supercooling expansion valve 273. The refrigerant expanded in the indoor supercooling expansion valve 273 may be heat-exchanged with the refrigerant passing through the indoor supercooling heat exchanger 271 to be evaporated, or may cool the refrigerant passing through the indoor supercooling heat exchanger 271. Further, the refrigerant evaporated in the indoor supercooling heat exchanger 271 returns to the indoor low-pressure pipe 242 through the supercooler return line 276.

The refrigerant having passed through the indoor supercooler 270 returns to the outdoor unit A through the indoor supercooler-liquid line connection pipe 275 and the liquid line 103. The refrigerant flowing to the outdoor unit A through the liquid line 103 may be circulated by passing through the outdoor heat exchanger 50, the second four-way valve 40, and the accumulator 60 to flow to the compressors 11 and 12.

Figure 10:
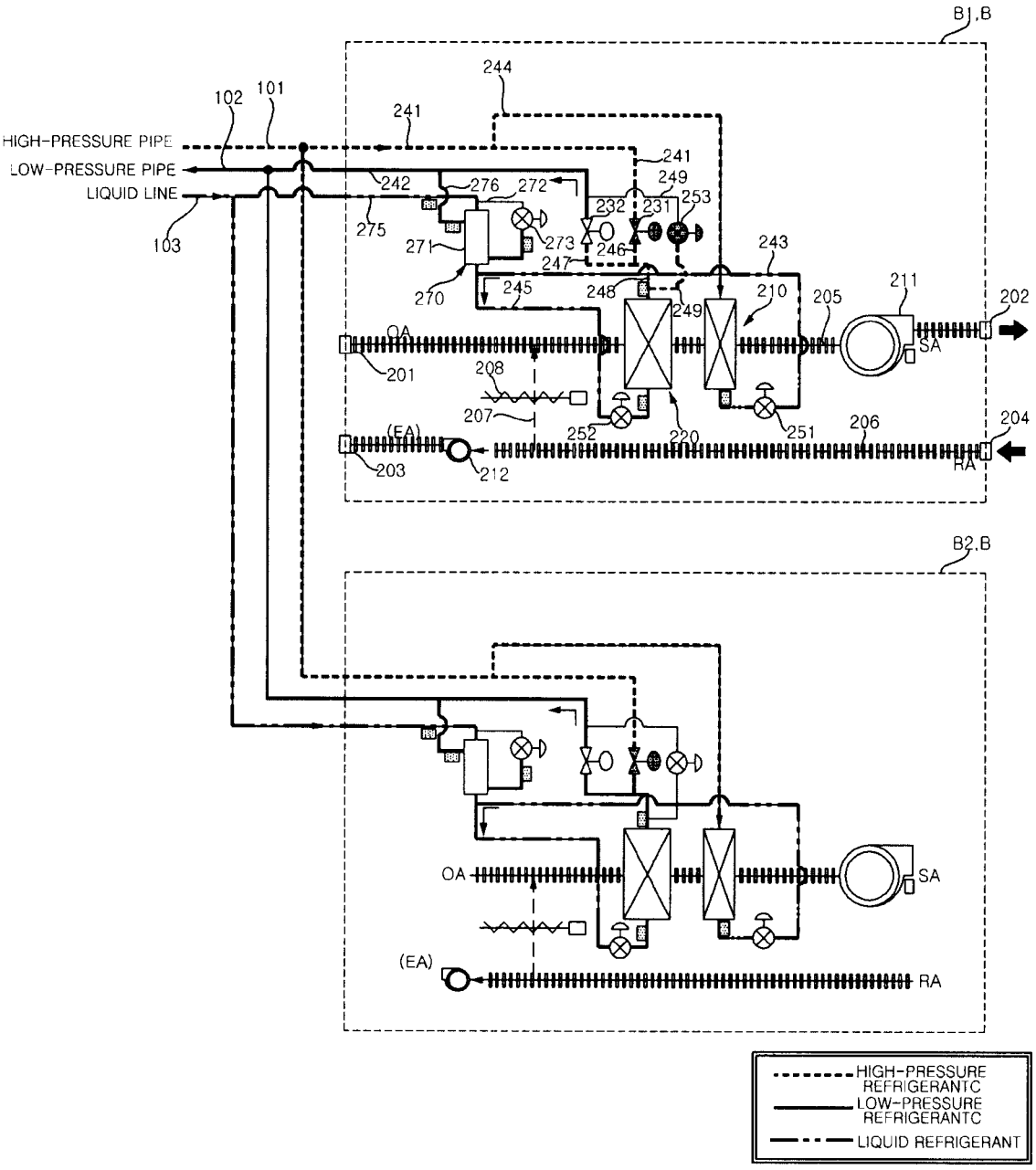
FIG. 10 is a diagram illustrating a flow of refrigerant when the plurality of indoor units illustrated in FIG. 3 are operated in a cooling-only operation mode.

FIG. 10 is a diagram illustrating a flow of refrigerant when the plurality of indoor units illustrated in FIG. 3 are operated in a cooling-only operation mode. In the cooling-only operation mode, both the indoor units B1 and B2 perform the cooling operation. The cooling-only operation mode will be described with reference to FIG. 10.

The outdoor unit A performs the cooling operation, and refrigerant condensed through the liquid line 103 of the outdoor unit A is supplied to the plurality of indoor units B1 and B2. The refrigerant supplied through the liquid line 103 passes through the indoor supercooler-liquid line connection pipe 275, the indoor supercooler 270, and the second supercooler connection pipe 245, to be supplied to the second indoor heat exchanger 220. Liquid refrigerant is expanded in the second indoor expansion valve 252 disposed in the second supercooler connection pipe 245, the expanded refrigerant is evaporated in the second indoor heat exchanger 220, and the expanded refrigerant may cool the air in the first indoor unit passage 205.

The controller of the indoor unit closes the high-pressure valve 231 and opens the low-pressure valve 232. The refrigerant evaporated in the second indoor heat exchanger 220 may return to the low-pressure pipe 102 by passing through the low-pressure valve 232 and the indoor low-pressure pipe 242.

If dehumidification is required in the indoor units B1 and B2, the first indoor heat exchanger 210 is operated, and the air cooled in the second indoor heat exchanger 220 may be heated in the first indoor heat exchanger 210. In this case, the controller of the indoor units is supplied with the compressed refrigerant through the high-pressure pipe 101 and the indoor high-pressure pipe 241, and as the high-pressure valve 231 is closed, the compressed refrigerant may be supplied to the first indoor heat exchanger 210 through the indoor high-pressure bypass pipe 244.

The first indoor heat exchanger 210 condenses the compressed refrigerant, and the condensed refrigerant may flow to the first supercooler connection pipe 243. In this case, the refrigerant flowing to the first supercooler connection pipe 243 may return to the second supercooler connection pipe 245 to join the refrigerant flowing to the second indoor heat exchanger 220, and then may be evaporated in the second indoor heat exchanger 220.

Figure 11:
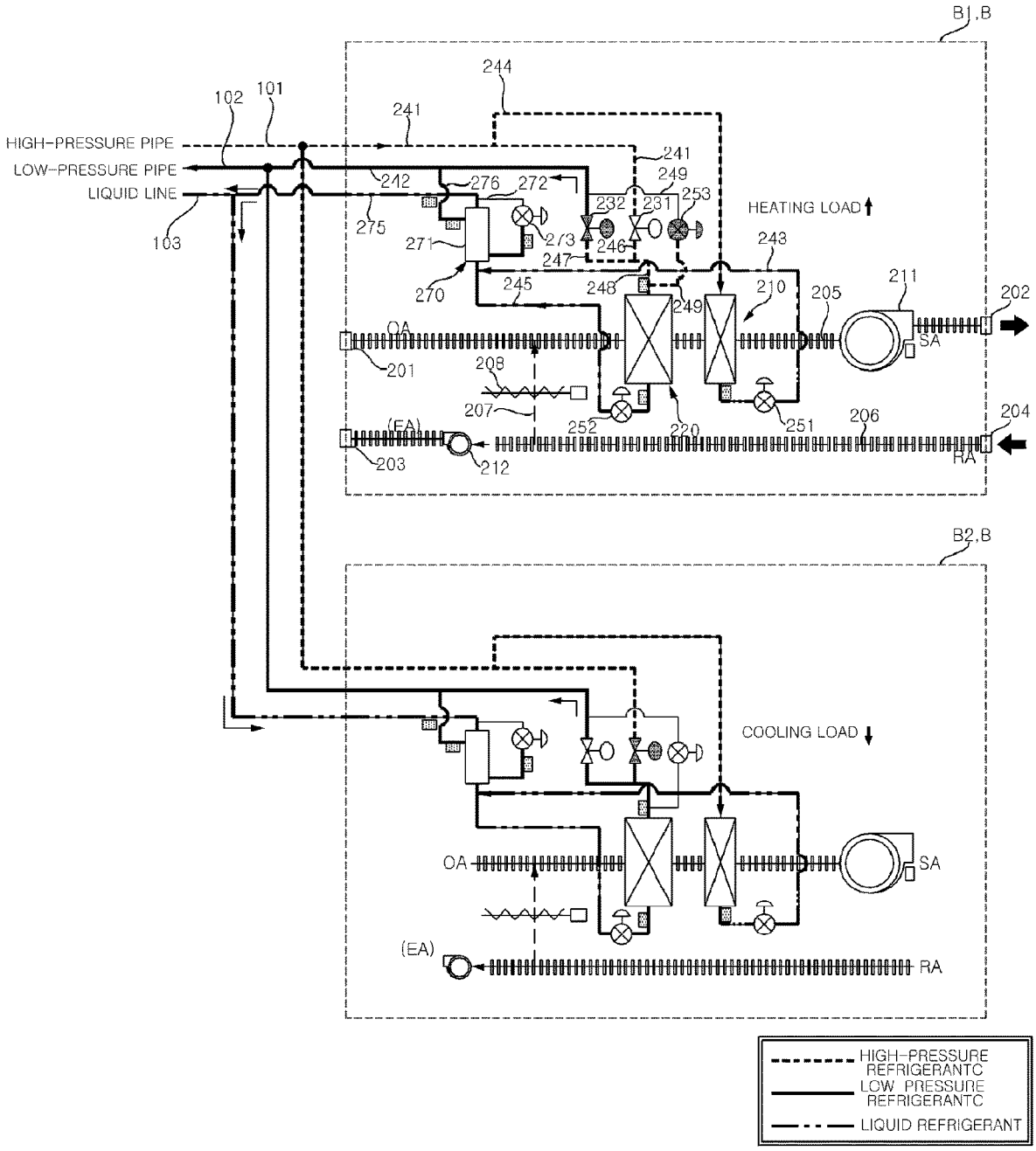
FIG. 11 is a diagram illustrating a flow of refrigerant when the plurality of indoor units illustrated in FIG. 3 are operated in a heating-main simultaneous operation.

FIG. 11 is a diagram illustrating a flow of refrigerant when the plurality of indoor units illustrated in FIG. 3 are operated in a heating-main simultaneous operation. The heating-main simultaneous operation is performed when the heating load is greater than the cooling load, in which some of the plurality of indoor units B1 and B2 perform the heating operation and the rest of the indoor units perform the cooling operation.

The heating-main simultaneous operation will be described with reference to FIG. 11. For convenience of explanation, the first indoor unit B1 performs the heating operation, and the second indoor unit B2 performs the cooling operation. The outdoor unit A performs the heating operation, and refrigerant of the compressors 11 and 12 is supplied through the high-pressure pipe 101 of the outdoor unit A.

The refrigerant supplied through the high-pressure pipe 101 is supplied to the first indoor heat exchanger 20 and the second heat exchanger 220 of the first indoor unit B1, and is supplied to the first indoor heat exchanger 210 of the second indoor unit B2. The operation of the first indoor unit B1, which performs the heating operation, is the same as the operation illustrated in FIG. 9, and the operation of the second indoor unit B2, which performs the cooling operation, is the same as the operation illustrated in FIG. 10. Accordingly, the controller of the first indoor unit B1, performing the heating operation, circulates the refrigerant by opening the high-pressure valve 231 and closing the low-pressure valve 232.

By contrast, the controller of the second indoor unit B2, performing the cooling operation, circulates the refrigerant by closing the high-pressure valve 231 and opening the low-pressure valve 232. A portion of the refrigerant condensed in the first indoor heat exchanger 210 and the second indoor heat exchanger 220 of the first indoor unit B1 may be evaporated in the outdoor heat exchanger 50 of the outdoor unit A through the indoor low-pressure pipe 242, and the rest of the condensed refrigerant may flow toward the second indoor unit B2 to be evaporated. That is, the rest of the condensed refrigerant flows to the indoor low-pressure pipe 242 of the second indoor unit B2 and may be evaporated in the second indoor heat exchanger 220 of the second indoor unit B2. That is, after being used for the heating operation of the first indoor unit B1, the condensed refrigerant may be supplied to the second indoor unit B2 for the cooling operation thereof, such that efficiency may be improved.

The low-pressure refrigerant, having circulated through the first indoor unit B1 and the second indoor unit B2, returns to the low-pressure pipe 102 through the indoor low-pressure pipe 242, and the liquid refrigerant returns to the liquid line 103 through the indoor supercooler-liquid line connection pipe 275.

Figure 12:
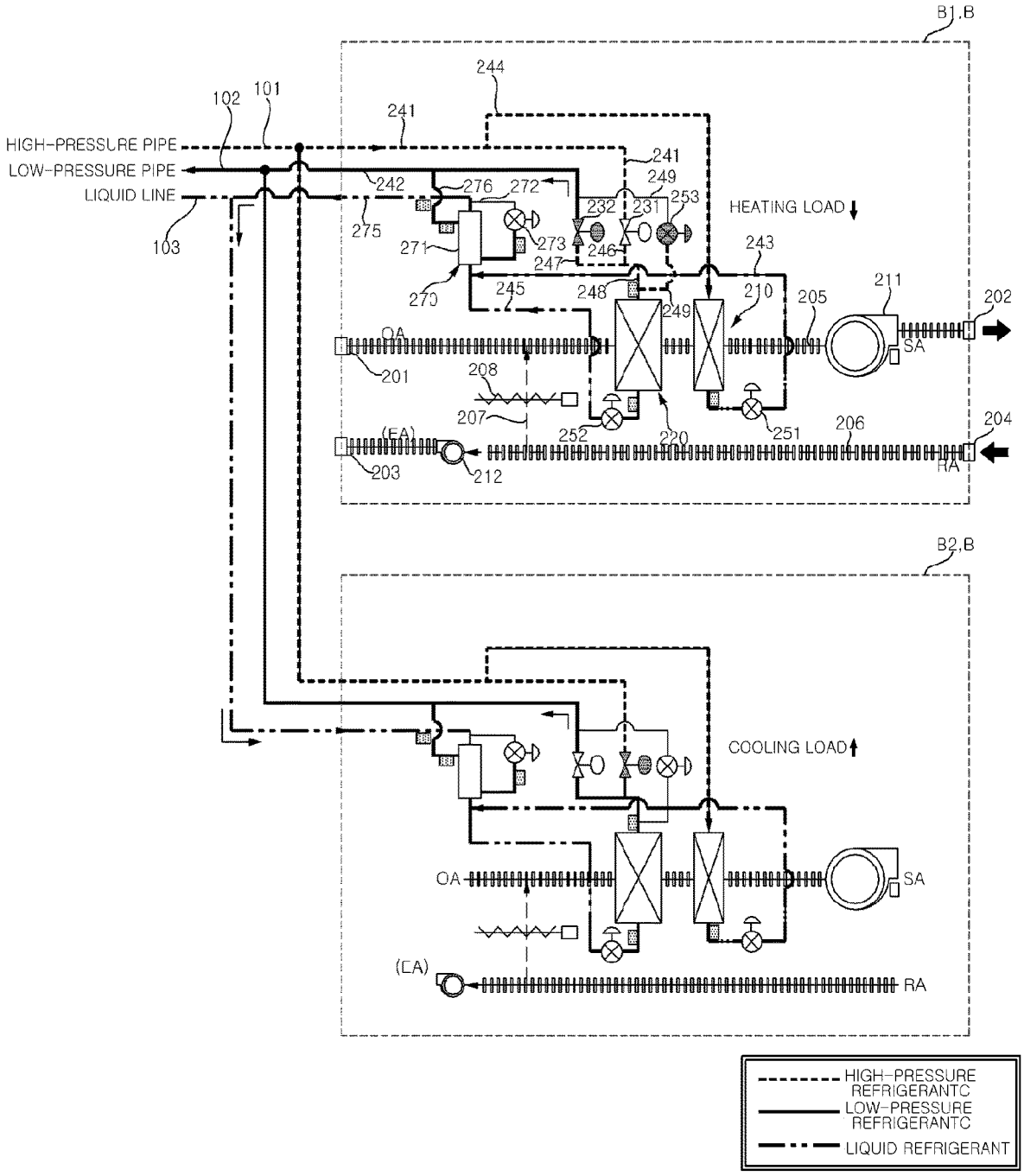
FIG. 12 is a diagram illustrating a flow of refrigerant when the plurality of indoor units illustrated in FIG. 3 are operated in a cooling-main simultaneous operation.

The cooling-main simultaneous operation is performed when the cooling load is greater than the heating load, in which some of the plurality of indoor units B1 and B2 perform the heating operation and the rest of the indoor units perform the cooling operation. The cooling-main simultaneous operation will be described with reference to FIG. 12. For convenience of explanation, the first indoor unit B1 performs the heating operation, and the second indoor unit B2 performs the cooling operation.

The outdoor unit A performs the cooling operation, and a portion of the refrigerant, compressed by the compressors 11 and 12 of the outdoor unit A, is condensed in the outdoor heat exchanger 50 and then flows to the second indoor unit B2 through the liquid line 103, and the rest of the compressed refrigerant flows to the first indoor unit B1 through the high-pressure pipe 101. The operation of the first indoor unit B1, which performs the heating operation, is the same as the operation illustrated in FIG. 9, and the operation of the second indoor unit B2, which performs the cooling operation, is the same as the operation illustrated in FIG. 10. Accordingly, the controller of the first indoor unit B1, performing the heating operation, circulates the refrigerant by opening the high-pressure valve 231 and closing the low-pressure valve 232.

By contrast, the controller of the second indoor unit B2, performing the cooling operation, circulates the refrigerant by closing the high-pressure valve 231 and opening the low-pressure valve 232. The refrigerant, condensed in the first indoor unit B1, flows to the indoor low-pressure pipe 242 of the second indoor unit B2 through the indoor low-pressure pipe 242 and may be evaporated in the second indoor heat exchanger 220.

That is, after being used for the heating operation of the first indoor unit B1, the condensed refrigerant may be supplied to the second indoor unit B2 for the cooling operation thereof, such that efficiency may be improved. The low-pressure refrigerant, having circulated through the second indoor unit B2, returns to the low-pressure pipe 102 through the indoor low-pressure pipe 242.

The description of embodiments is for illustrative, and it may be understood that those skilled in the art may easily modify the embodiments into other particular forms without changing the technical spirit or the essential characteristics. Thus, it shall be appreciated that the exemplary embodiments described above are intended to be illustrative in every sense, and not restrictive. The scope is defined by the claims rather than by the description of embodiments, and it shall be interpreted that the meaning and scope of the claims and all the changes or modified forms derived from the equivalents thereof belong to the scope.

Embodiments disclosed herein provide a multi-type air conditioner capable of ventilating indoor air and outside air, in which some of a plurality of indoor units may perform a cooling operation, and the rest of the indoor units may perform a heating operation. Embodiments disclosed herein further provide a multi-type air conditioner in which when some of a plurality of indoor units perform a cooling operation, and the rest of the indoor units perform a heating operation, waste heat from any one of the indoor units may be recovered. Embodiments disclosed herein have an advantage in that while having three pipes including a high-pressure pipe, a low-pressure pipe, and a liquid line, there is no need for an HR (Heat Recovery) unit, thereby allowing installation with significantly less difficulty.

In a multi-type air conditioner according to embodiments disclosed herein, three pipes including a high-pressure pipe, a low-pressure pipe, and a liquid line, may be connected to a plurality of indoor units, in which some of the indoor units may be operated in a cooling mode and the others may be operated in a heating mode, and waste heat from the indoor units operated in the heating mode may be recovered to be used for the indoor units operated in the cooling mode. A first indoor heat exchanger and a second indoor heat exchanger may be disposed in a first indoor unit passage and a second indoor heat exchanger operated in a cooling mode dehumidifies air flowing in the first indoor unit passage, and the first indoor heat exchanger operated in a heating mode heats the dehumidified air, such that air may be discharged at a similar temperature to the indoor air. A high-pressure valve connected to a high-pressure pipe and a low-pressure valve connected to a low-pressure pipe may be connected to a second indoor heat exchanger, such that the second indoor heat exchanger may be operated in a cooling mode or a heating mode.

Embodiments disclosed herein provide a multi-type air conditioner, that may include a case connected to an outdoor unit through a high-pressure pipe, a low-pressure pipe, and a liquid line; a first indoor heat exchanger and a second indoor heat exchanger disposed in the case; a high-pressure valve connected to the high-pressure pipe and controlling a flow of refrigerant; a low-pressure valve connected to the low-pressure pipe and controlling a flow of refrigerant; an indoor high-pressure pipe connecting the high-pressure valve and the high-pressure pipe; an indoor high-pressure bypass pipe connecting the indoor high-pressure pipe and the first indoor heat exchanger; an indoor low-pressure pipe connecting the low-pressure valve and the low-pressure pipe; and a connection pipe connecting the high-pressure valve and the low-pressure valve to the second indoor heat exchanger. The case may include a first inlet through which outside air may be drawn in; a first outlet through which air, having passed through the first indoor heat exchanger and the second heat exchanger, may be discharged into a room; a second inlet through which indoor air may be drawn in; and a second outlet through which the indoor air, drawn in through the second inlet, may be discharged outside.

The multi-type air conditioner may further include a first indoor unit passage connecting the first inlet and the first outlet. The first indoor heat exchanger and the second indoor heat exchanger may be disposed in the first indoor unit passage. The first indoor heat exchanger may be disposed near the first outlet, and the second indoor heat exchanger may be disposed near the first inlet.

The multi-type air conditioner may further include a first indoor unit passage connecting the first inlet and the first outlet; a second indoor unit passage connecting the second inlet and the second outlet; and an indoor bypass passage connecting the first indoor unit passage and the second indoor unit passage. The multi-type air conditioner may further include a damper disposed in the indoor bypass passage, and controlling an air flow amount in the indoor bypass passage. The indoor bypass passage may be connected between the first inlet and the second indoor heat exchanger.

The multi-type air conditioner may further include an indoor supercooler-liquid line connection pipe connected to the liquid line and causing a refrigerant to flow; an indoor supercooler connected to the indoor supercooler-liquid line connection pipe; a first supercooler connection pipe connecting the indoor supercooler and the first indoor heat exchanger; and a second supercooler connection pipe connecting the indoor supercooler and the second indoor heat exchanger. The multi-type air conditioner may further include a first indoor expansion valve disposed in the first supercooler connection pipe. The multi-type air conditioner may further include a second indoor expansion valve disposed in the second supercooler connection pipe.

The indoor supercooler may further include an indoor supercooling heat exchanger disposed in the second supercooler connection pipe; an indoor supercooling bypass pipe branched from the second supercooler connection pipe to be connected to the indoor supercooling heat exchanger; an indoor supercooling expansion valve disposed in the indoor supercooling bypass pipe; and an indoor supercooler return line connecting the indoor supercooling heat exchanger and the indoor low-pressure pipe. The multi-type air conditioner may further include a low-pressure bypass pipe connecting the connection pipe and the indoor low-pressure pipe; and a third indoor expansion valve disposed in the low-pressure bypass pipe. The connection pipe may further include a high-pressure valve-second indoor heat exchanger connection pipe connecting the high-pressure valve and the second indoor heat exchanger; and a low-pressure valve-second indoor heat exchanger connection pipe connecting the low-pressure valve and the second indoor heat exchanger.

The multi-type air conditioner may further include a junction pipe, to which the high-pressure valve-second indoor heat exchanger connection pipe and the low-pressure valve-second indoor heat exchanger connection pipe are joined. The junction pipe may be connected to the second indoor heat exchanger.

The multi-type air conditioner may further include a low-pressure bypass pipe connecting the junction pipe and the indoor low-pressure pipe; and the third indoor expansion valve disposed in the low-pressure bypass pipe.

The multi-type air conditioner according to embodiments disclosed herein have one or more of the following advantages.

First, in the multi-type air conditioner according to embodiments disclosed herein, three pipes including a high-pressure pipe, a low-pressure pipe, and a liquid line, are connected to a plurality of indoor units, in which some of the indoor units may be operated in a cooling mode and the others may be operated in a heating mode, and waste heat from the indoor units operated in the heating mode may be recovered to be used for the indoor units operated in the cooling mode.

Second, in the multi-type air conditioner according to embodiments disclosed herein, a first indoor heat exchanger and a second indoor heat exchanger are disposed in a first indoor unit passage and a second indoor heat exchanger operated in a cooling mode dehumidifies air flowing in the first indoor unit passage, and the first indoor heat exchanger operated in a heating mode heats the dehumidified air, such that air may be discharged at a similar temperature to the indoor air.

Third, in the multi-type air conditioner according to embodiments disclosed herein, a high-pressure valve connected to a high-pressure pipe and a low-pressure valve connected to a low-pressure pipe are connected to a second indoor heat exchanger, such that the second indoor heat exchanger may be operated in a cooling mode or a heating mode.

Fourth, in the multi-type air conditioner according to embodiments disclosed herein, while having three pipes including a high-pressure pipe, a low-pressure pipe, and a liquid line, there is no need for an HR unit, thereby allowing installation with significantly less difficulty.

Advantages of the embodiments disclosed herein are not limited to the aforesaid, and other advantages not described will be clearly understood by those skilled in the art from the description of the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A multi-type air conditioner, comprising:

a case connected to an outdoor unit through a high-pressure pipe, a low-pressure pipe, and a liquid line;

a first indoor heat exchanger and a second indoor heat exchanger disposed in the case;

a high-pressure valve connected to the high-pressure pipe and controlling a flow of refrigerant;

a low-pressure valve connected to the low-pressure pipe and controlling a flow of refrigerant;

an indoor high-pressure pipe that connects the high-pressure valve and the high-pressure pipe;

an indoor high-pressure bypass pipe that connects the indoor high-pressure pipe and the first indoor heat exchanger;

an indoor low-pressure pipe that connects the low-pressure valve and the low-pressure pipe;

a connection pipe that connects the high-pressure valve and the low-pressure valve to the second indoor heat exchanger;

an indoor supercooler-liquid line connection pipe connected to the liquid line and causing refrigerant to flow;

an indoor supercooler connected to the indoor supercooler-liquid line connection pipe;

a first supercooler connection pipe that connects the indoor supercooler and the first indoor heat exchanger; and a second supercooler connection pipe that connects the indoor supercooler and the second indoor heat exchanger.

2. The multi-type air conditioner of claim 1, wherein the indoor supercooler further comprises:

an indoor supercooling heat exchanger disposed in the second supercooler connection pipe;

an indoor supercooling bypass pipe branched from the second supercooler connection pipe to be connected to the indoor supercooling heat exchanger;

an indoor supercooling expansion valve disposed in the indoor supercooling bypass pipe; and an indoor supercooler return line that connects the indoor supercooling heat exchanger and the indoor low-pressure pipe.

3. The multi-type air conditioner of claim 1, further comprising a first indoor expansion valve disposed in the first supercooler connection pipe.

4. The multi-type air conditioner of claim 3, further comprising a second indoor expansion valve disposed in the second supercooler connection pipe.

5. The multi-type air conditioner of claim 4, further comprising:

a low-pressure bypass pipe that connects the connection pipe and the indoor low-pressure pipe; and a third indoor expansion valve disposed in the low-pressure bypass pipe.

6. The multi-type air conditioner of claim 1, wherein the connection pipe comprises:

a high-pressure valve-second indoor heat exchanger connection pipe that connects the high-pressure valve and the second indoor heat exchanger; and a low-pressure valve-second indoor heat exchanger connection pipe that connects the low-pressure valve and the second indoor heat exchanger.

7. The multi-type air conditioner of claim 6, further comprising a junction pipe, to which the high-pressure valve-second indoor heat exchanger connection pipe and the low-pressure valve-second indoor heat exchanger connection pipe are joined, wherein the junction pipe is connected to the second indoor heat exchanger.

8. The multi-type air conditioner of claim 7, further comprising:

a low-pressure bypass pipe that connects the junction pipe and the indoor low-pressure pipe, wherein an expansion valve is disposed in the low-pressure bypass pipe.

9. The multi-type air conditioner of claim 1, wherein the case comprises:

a first inlet through which outside air is drawn in;

a first outlet through which air, having passed through the first indoor heat exchanger and the second heat exchanger, is discharged into a room;

a second inlet through which indoor air is drawn in; and a second outlet through which the indoor air, drawn in through the second inlet, is discharged outside.

10. The multi-type air conditioner of claim 9, further comprising a first indoor unit passage that connects the first inlet and the first outlet, wherein the first indoor heat exchanger and the second indoor heat exchanger are disposed in the first indoor unit passage.

11. The multi-type air conditioner of claim 9, wherein the first indoor heat exchanger is disposed near the first outlet, and the second indoor heat exchanger is disposed near the first inlet.

12. The multi-type air conditioner of claim 9, further comprising:

a first indoor unit passage that connects the first inlet and the first outlet;

a second indoor unit passage that connects the second inlet and the second outlet; and an indoor unit bypass passage that connects the first indoor unit passage and the second indoor unit passage.

13. The multi-type air conditioner of claim 12, further comprising a damper disposed in the indoor unit bypass passage, and controlling an air flow amount in the indoor unit bypass passage.

14. The multi-type air conditioner of claim 12, wherein the indoor unit bypass passage is connected to the first indoor unit passage at a point between the first inlet and the second indoor heat exchanger.

15. A multi-type air conditioner, comprising:

an outdoor unit;

at least one indoor unit, including:

a case connected to the outdoor unit through a high-pressure pipe, a low-pressure pipe, and a liquid line;

a first indoor heat exchanger and a second indoor heat exchanger disposed in the case;

a high-pressure valve connected to the high-pressure pipe and controlling a flow of refrigerant;

a low-pressure valve connected to the low-pressure pipe and controlling a flow of refrigerant;

an indoor high-pressure pipe that connects the high-pressure valve and the high-pressure pipe;

an indoor high-pressure bypass pipe that connects the indoor high-pressure pipe and the first indoor heat exchanger;

an indoor low-pressure pipe that connects the low-pressure valve and the low-pressure pipe;

a connection pipe that connects the high-pressure valve and the low-pressure valve to the second indoor heat exchanger;

a first inlet through which outside air is drawn in;

a first outlet through which air, having passed through the first indoor heat exchanger and the second heat exchanger, is discharged into a room;

a second inlet through which indoor air is drawn in; and a second outlet through which the indoor air, drawn in through the second inlet, is discharged outside;

a first indoor unit passage that connects the first inlet and the first outlet;

a second indoor unit passage that connects the second inlet and the second outlet;

an indoor unit bypass passage that connects the first indoor unit passage and the second indoor unit passage;

a damper disposed in the indoor unit bypass passage, and controlling an air flow amount bypassed from the second indoor unit passage to the first indoor unit passage;

an indoor supercooler-liquid line connection pipe connected to the liquid line and causing refrigerant to flow;

an indoor supercooler connected to the indoor supercooler-liquid line connection pipe;

a first supercooler connection pipe that connects the indoor supercooler and the first indoor heat exchanger; and a second supercooler connection pipe that connects the indoor supercooler and the second indoor heat exchanger.

16. The multi-type air conditioner of claim 15, wherein the indoor unit bypass passage is connected to the first indoor unit passage at a point between the first inlet and the second indoor heat exchanger.

17. A multi-type air conditioner, comprising:

an outdoor unit;

at least one indoor unit, including:

a case connected to an outdoor unit through a high-pressure pipe, a low-pressure pipe, and a liquid line;

a first indoor heat exchanger and a second indoor heat exchanger disposed in the case;

a high-pressure valve connected to the high-pressure pipe and controlling a flow of refrigerant;

a low-pressure valve connected to the low-pressure pipe and controlling a flow of refrigerant;

an indoor high-pressure pipe that connects the high-pressure valve and the high-pressure pipe;

an indoor high-pressure bypass pipe that connects the indoor high-pressure pipe and the first indoor heat exchanger;

an indoor low-pressure pipe that connects the low-pressure valve and the low-pressure pipe;

an indoor supercooler-liquid line connection pipe connected to the liquid line and causing refrigerant to flow;

an indoor supercooler connected to the indoor supercooler-liquid line connection pipe;

a first supercooler connection pipe that connects the indoor supercooler and the first indoor heat exchanger;

a second supercooler connection pipe that connects the indoor supercooler and the second indoor heat exchanger; and a connection pipe that connects the high-pressure valve and the low-pressure valve to the second indoor heat exchanger, wherein the connection pipe comprises:

a high-pressure valve-second indoor heat exchanger connection pipe that connects the high-pressure valve and the second indoor heat exchanger;

a low-pressure valve-second indoor heat exchanger connection pipe that connects the low-pressure valve and the second indoor heat exchanger.

18. The multi-type air conditioner of claim 17, further comprising a junction pipe, to which the high-pressure valve-second indoor heat exchanger connection pipe and the low-pressure valve-second indoor heat exchanger connection pipe are joined, wherein the junction pipe is connected to the second indoor heat exchanger.

19. The multi-type air conditioner of claim 18, further comprising:

a low-pressure bypass pipe that connects the junction pipe and the indoor low-pressure pipe, wherein an expansion valve is disposed in the low-pressure bypass pipe.

* * * * *